US007712424B2

(12) United States Patent
Madden et al.

(10) Patent No.: US 7,712,424 B2
(45) Date of Patent: May 11, 2010

(54) MULTI-HULL VESSEL ADAPTED FOR ICE-BREAKING

(75) Inventors: Lewis D. Madden, Morgan Hill, CA (US); Stephen L. Bailey, Los Gatos, CA (US); Roger B. Streeter, Benicia, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 694 days.

(21) Appl. No.: 11/278,021

(22) Filed: Mar. 30, 2006

(65) Prior Publication Data

US 2007/0039532 A1 Feb. 22, 2007

Related U.S. Application Data

(60) Provisional application No. 60/710,111, filed on Aug. 22, 2005.

(51) Int. Cl.
*B63B 1/00* (2006.01)

(52) U.S. Cl. ..... 114/40; 114/61.14

(58) Field of Classification Search ..... 114/40, 114/41, 42, 61.1, 61.12, 61.14, 61.2
See application file for complete search history.

(56) References Cited

U.S. PATENT DOCUMENTS 3,521,590 A * 7/1970 Alexander et al. ..... 114/41
3,754,523 A * 8/1973 Devine ..... 114/40
3,768,427 A * 10/1973 Stephens ..... 114/41
3,817,199 A * 6/1974 Schirtzinger ..... 114/42
4,798,153 A 1/1989 Schmidt
RE33,359 E * 10/1990 Lang ..... 114/283
5,301,624 A 4/1994 Hall et al.

FOREIGN PATENT DOCUMENTS

DE 2029049 A 12/1971
DE 2206472 A 8/1973
DE 2752754 A 6/1978
GB 1215530 A1 12/1970
GB 2 010 201 A * 6/1979
SE 445441 B 6/1986

* cited by examiner

*Primary Examiner*—S. Joseph Morano
(74) *Attorney, Agent, or Firm*—DeMont & Breyer, LLC

(57) ABSTRACT

A multi-hulled vessel for upward ice-breaking is disclosed. The vessel has side hulls that are at least partially submerged while the vessel is underway. The side hulls each have a ridge on their upper surface. To break through ice at sea, the side hulls are positioned under the ice and the trim is adjusted for an upward trim angle. As the vessel moves forward, the ice is lifted and force concentrates along the ridge on the side hulls. The ice breaks along this force concentration, aided by the weight of the ice itself.

4 Claims, 4 Drawing Sheets

MULTI-HULL VESSEL ADAPTED FOR ICE-BREAKING

STATEMENT OF RELATED CASES

This case claims priority of U.S. provisional patent application 60/710,111, which was filed on Aug. 22, 2005 and is incorporated by reference herein.

FIELD OF THE INVENTION

The present invention relates to sea-faring vessels. More particularly, the present invention relates to a vessel having a multiple hulls.

BACKGROUND OF THE INVENTION

Vessels that are required to navigate through ice-covered waters are typically mono-hull designs. These mono-hull vessels are usually designed to break the ice via a downward force that is applied by a wide spoon-shaped bow. The specially-designed bow presses down on the ice to break it as the vessel moves forward.

Very few multi-hull ships, such as catamarans and SWATH craft, are capable of operating in ice. Catamarans, for example, typically have narrow hulls that cannot apply sufficient downward force to break ice. SWATH (Small Waterplane Area Twin Hull) vessels, which usually have two pontoon-like lower hulls that are connected to a catamaran-like upper or center hull via struts, have, with limited success, been adapted for ice-breaking operation. The adaptation is to reinforce the struts, the upper portion of the lower hulls, and the lower portion of the upper hull.

The reinforced struts of known ice-breaking-enabled SWATH vessels break ice through a crushing, compressive force. This force must be large, which requires excessive power, since ice presents great resistance to breaking under compressive force (similar to concrete).

A need remains, therefore, for a ice-breaking-enabled multi-hull ship that breaks ice in a more power-efficient manner than those of the prior art.

SUMMARY OF THE INVENTION

The present invention provides a way to adapt multi-hull vessels for ice-breaking without some of the costs and disadvantages of the prior art.

In the illustrative embodiment, a SWATH vessel is adapted for upward ice-breaking by modifying its lower hulls and struts to:

- lift the ice along an edge, cutting it from below, thereby enabling it to fracture and break from the force of its own weight in bending; and
- to promote separation of the ice from the struts of the SWATH vessel.

A modification that is responsible for cutting the ice is the reinforcement of the lower hulls and the addition of a narrow ridge or edge near the bow of each lower hull. As the vessel moves forward, the ice is lifted and force concentrates along the narrow ridge. The ice then breaks along the line of force concentration.

A modification that promotes separation of the ice from the struts is to taper the struts such that the widest portion of the strut at the waterline is near the longitudinal mid-point of the lower hull, rather than at its stern, as is typical in multi-hull vessels. The aft-tapering waterline that results from this modification generates a "reamer" effect wherein ice that was in contact with the struts separates from the struts. Generally, the aft-tapering waterline results in a reduction in the frictional resistance of the lower hull/ice interface.

DETAILED DESCRIPTION

Figure 1:
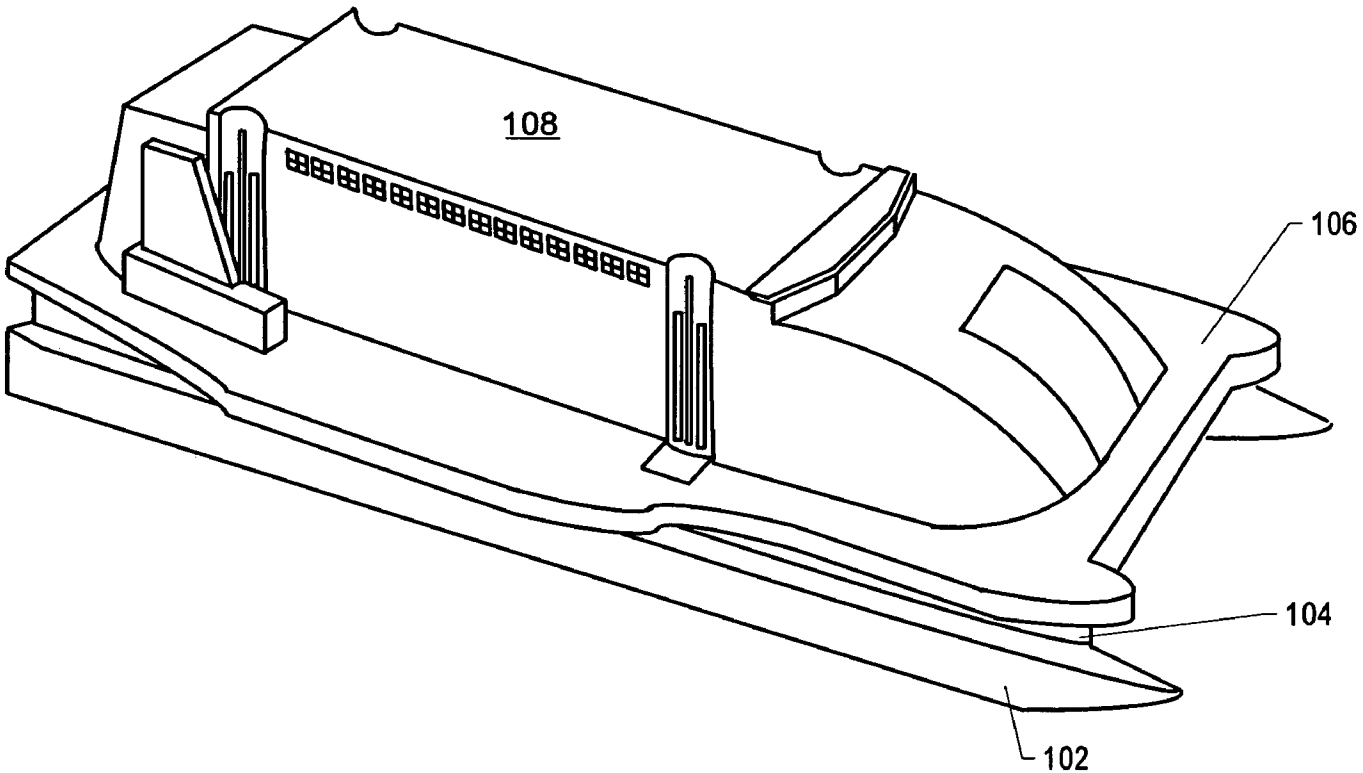
FIG. 1 depicts a multi-hull vessel in accordance with the illustrative embodiment of the present invention.

FIG. 1 depicts multi-hull vessel 100 in accordance with the illustrative embodiment of the present invention. Vessel 100 includes side hulls 102, struts 104, sponson 106, and deck house 108. The deck house, which is also referred to as the center hull, incorporates a pilot house, and, internally, a (lower) deck for vehicles and an (upper) deck for passengers. During normal operation, side hulls 102 are submerged (SWATH) or partially submerged (catamaran), while center hull typically remains above the waterline.

In accordance with the illustrative embodiment, multi-hull vessel 100 has certain modifications, relative to prior-art multi-hull vessels, which make it well suited to ice-breaking.

Figure 2:
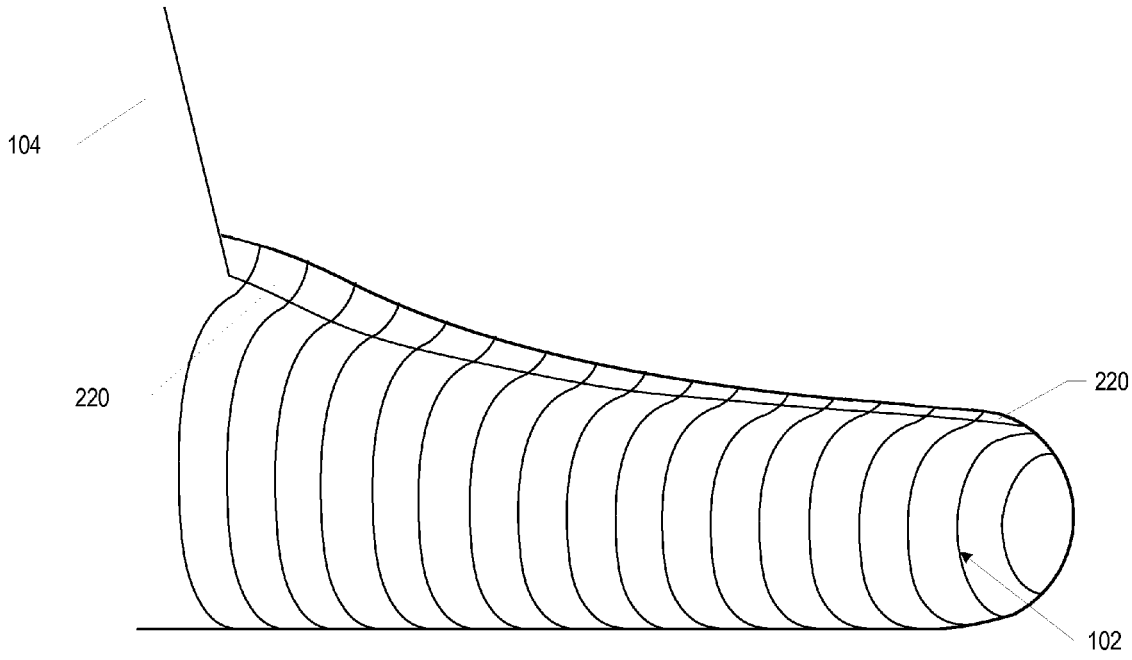
FIG. 2 depicts a narrow ridge at the forward portion of each lower hull of the vessel of FIG. 1.

In particular, the upper surface of the bow of side hulls 102 incorporate ridge 220, as depicted in FIG. 2. In some embodiments, ridge 220 is formed as an integral portion of side hulls 102. In some other embodiments, ridge 220 is manufactured independently of side hulls 102 and then attached thereto. Those skilled in the art, after reading the present disclosure, will be able to design and fabricate ridge 220 for use herein.

As side-hulls move forward under ice, the ice is lifted and force concentrates along ridge 220. The ice breaks along this force concentration. This is a far more efficient way to break ice than reinforcing struts 104 and simply compressing the ice to failure, as performed by multi-hull vessels in the prior art. Upward ice breaking takes advantage of the weight of the ice. That is, in addition to any upward force applied to the ice by virtue of the trim angle and propulsion, the weight of the ice itself is harnessed for the breaking operation.

Assuming that vessel 100 is underway with zero trim, as it approaches ice, an initial trim of 2 degrees (bow up) is obtained by moving the center of gravity aft using ballast water. Upon entering ice, the vessel is trimmed forward 1.5 degrees due to the downward force of the ice for a net upward trim angle of 0.5 degrees. The upward trim angle and forward motion of vessel 100 imparts the upward force that enables ice-breaking.

Figure 3A:
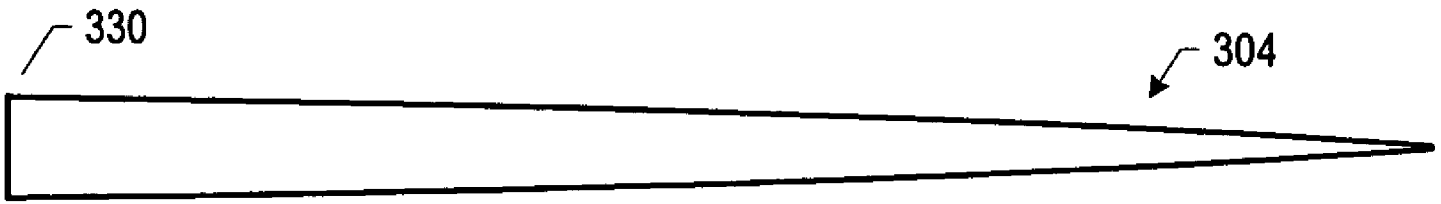
Figure 3A Prior Art
FIG. 3A depicts, via a top-view, the waterline of a SWATH craft in the prior art at the struts, wherein the waterline is widest at the stern of the struts.
Figure 3B:
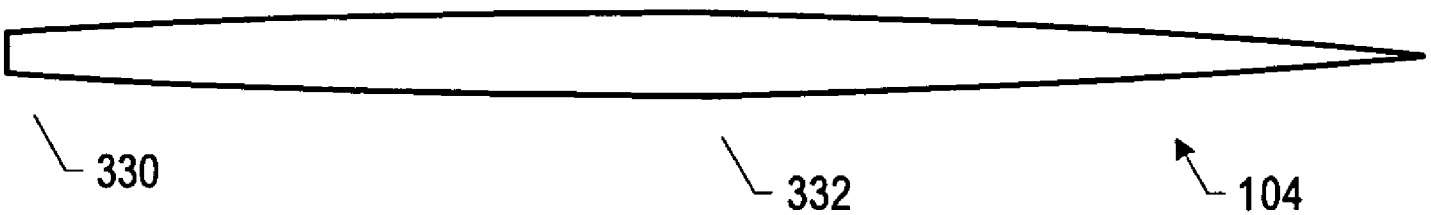
FIG. 3B depicts, via a top-view, the waterline of a SWATH craft in accordance with the illustrative embodiment of the present invention, wherein the waterline is widest near the longitudinal mid-point of the struts and tapers toward the stern.

A second modification for ice-breaking is related to the shape of strut 104. FIG. 3A depicts a top view of the waterline for strut 304 in the prior-art. As depicted in FIG. 3A, the width of strut 304 is greatest at its stern 330 when the vessel is not trimmed by ballast water. FIG. 3B depicts a top view of the waterline for strut 104 in accordance with the illustrative embodiment of the present invention. As depicted in FIG. 3B, strut 104 is widest near its mid-point 332, such that the waterline shows an aft-tapering profile after the vessel is trimmed by the stern.

It has been found that the aft-tapering waterline of strut 104 creates a "reamer" effect, wherein ice that is in contact with struts 104 separate from the struts.

Figure 4:
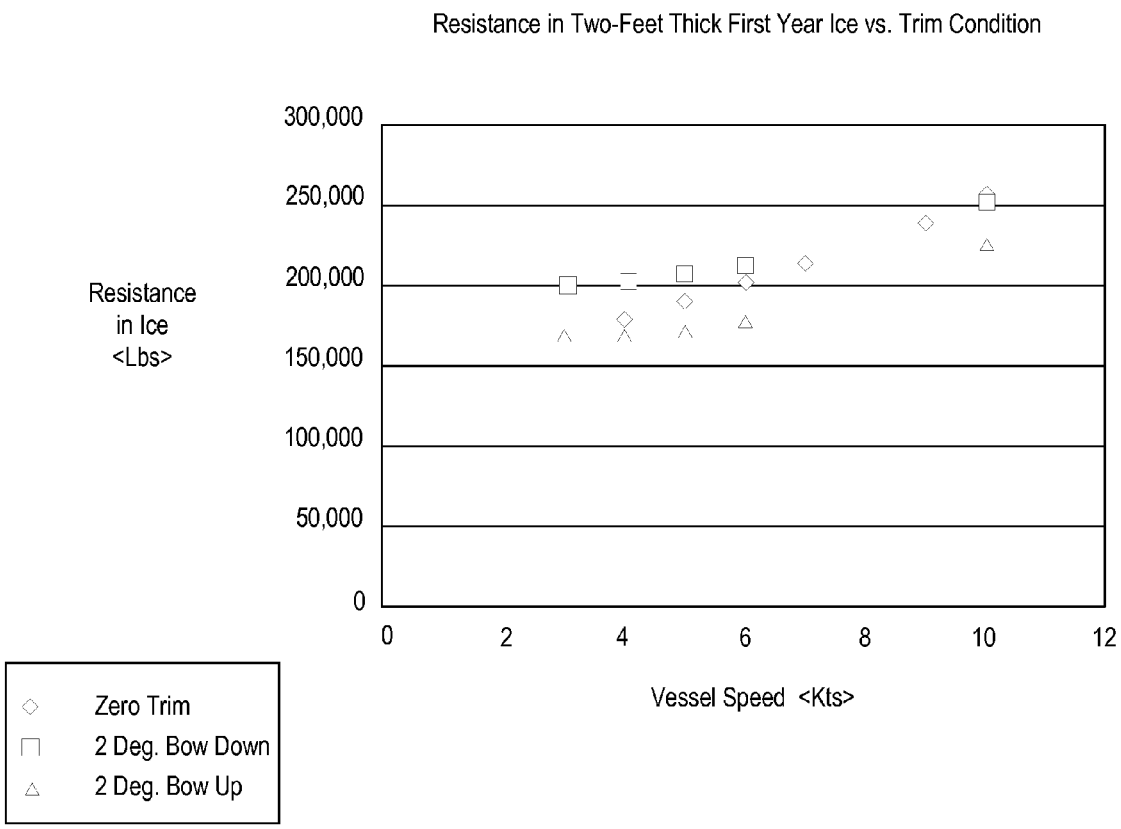
FIG. 4 depicts a plot comparing the resistance in ice of a multi-hull vessel as a function of trim condition and vessel speed.

FIG. 4 depicts a plot showing the resistance, in pounds, of two-feet thick first year ice as a function of the trim and speed of vessel 100. As depicted in FIG. 4, the lowest resistance in ice is in a bow-up trim condition.

A problem experienced by prior-art downward ice-breaking vessels is that ice is ingested into the ship's propulsion systems. But in the case of a multi-hull vessel that is equipped for upward ice-breaking as described herein, the vessel operates at a relatively deep draft with the stern even deeper due to the bow-up trim, reducing the possibility of ingesting ice.

It is to be understood that the above-described embodiments are merely illustrative of the present invention and that many variations of the above-described embodiments can be devised by those skilled in the art without departing from the scope of the invention. For example, in this Specification, numerous specific details are provided in order to provide a thorough description and understanding of the illustrative embodiments of the present invention. Those skilled in the art will recognize, however, that the invention can be practiced without one or more of those details, or with other methods, materials, components, etc.

Furthermore, in some instances, well-known structures, materials, or operations are not shown or described in detail to avoid obscuring aspects of the illustrative embodiments. It is understood that the various embodiments shown in the Figures are illustrative, and are not necessarily drawn to scale. Reference throughout the specification to "one embodiment" or "an embodiment" or "some embodiments" means that a particular feature, structure, material, or characteristic described in connection with the embodiment(s) is included in at least one embodiment of the present invention, but not necessarily all embodiments. Consequently, the appearances of the phrase "in one embodiment," "in an embodiment," or "in some embodiments" in various places throughout the Specification are not necessarily all referring to the same embodiment. Furthermore, the particular features, structures, materials, or characteristics can be combined in any suitable manner in one or more embodiments. It is therefore intended that such variations be included within the scope of the following claims and their equivalents.

What is claimed is:

1. A multi-hulled vessel comprising two side hulls that are connected by struts to a center hull, wherein said side hulls are at least partially submerged while said vessel is underway, and further wherein each of said two side hulls comprises a ridge that is disposed on an upper surface thereof, wherein:

(a) said side hulls extend a first distance forward of a leading edge of said struts;

(b) said ridge extends for at least a portion of said first distance from a bow of said side hulls toward said leading edge of said struts;

(c) when said vessel is underway in water having a surface layer of ice, a major portion of a length of said ridge is brought into contact with a bottom surface of said ice; and (d) said major portion of said ridge is sufficient to function as a force concentrator for concentrating a weight of said ice along said ridge in order to fracture said ice.

2. The multi-hulled vessel of claim 1 further comprising two struts for coupling said two side hulls to a center hull, wherein, at a waterline, said struts are widest near a midpoint along a length of said struts.

3. The multi-hulled vessel of claim 1 wherein said vessel is a small waterplane area twin hull craft.

4. The multi-hulled vessel of claim 1 wherein said vessel is a catamaran.

* * * * *